United States Patent [19]

Heddebaut et al.

[11] Patent Number: 4,873,531

[45] Date of Patent: Oct. 10, 1989

[54] IDENTIFICATION TRANSPONDER FOR USE WHEN A VEHICLE PASSES A GIVEN POINT

[75] Inventors: Marc Heddebaut, Sainghlin En Melantois; Pierre Mainardi, Douvrin; Pierre Degauque, Lambersart; Denis Duhot, Paris, all of France

[73] Assignee: Societe Anonyme dite : Alsthom, Paris, France

[21] Appl. No.: 271,814

[22] Filed: Nov. 16, 1988

[30] Foreign Application Priority Data

Nov. 20, 1987 [FR] France ..... 87 16092

[51] Int. Cl.[4] ..... H01Q 13/10

[52] U.S. Cl. ..... 343/711; 343/771

[58] Field of Search ..... 343/767, 770, 771, 711, 343/713, 717

[56] References Cited

U.S. PATENT DOCUMENTS

| | | | |
|---|---|---|---|
| Re. 28,302 | 1/1975 | Staras et al. . | |
| 3,281,591 | 10/1966 | Takeya . | |
| 3,328,800 | 6/1967 | Algeo | 343/771 |
| 3,348,227 | 10/1967 | Rolfs | 343/771 |
| 3,467,962 | 9/1969 | Laplume et al. . | |
| 3,599,216 | 8/1971 | Paine et al. | 343/771 |
| 3,648,172 | 3/1971 | Nakahara et al. | 343/771 |
| 4,716,415 | 12/1987 | Kelly | 343/771 |

*Primary Examiner*—Rolf Hille
*Assistant Examiner*—Michael C. Wimer
*Attorney, Agent, or Firm*—Sughrue, Mion, Zinn, Macpeak & Seas

[57] ABSTRACT

The transponder is constituted by a waveguide (1) having a large face (2) including longitudinal slots (3) and pairs of slots distributed along the axis (WW') of the large face at one pair per n longitudinal slots. Each pair is constituted by two transverse slots (4, 4') situated facing a longitudinal slot. The presence of a pair corresponds to a one value bit and the absence of a pair corresponds to a zero value bit. The longitudinal slots receive radiation from a transmit antenna (A1) including a low frequency and a high frequency. They radiate to a first receive antenna (A2) using radiation at the high frequency. The pairs radiate to a second receive antenna (A3) using radiation at the low frequency. The antennas are fixed relative to one another and they move relative to the transponder.

8 Claims, 1 Drawing Sheet

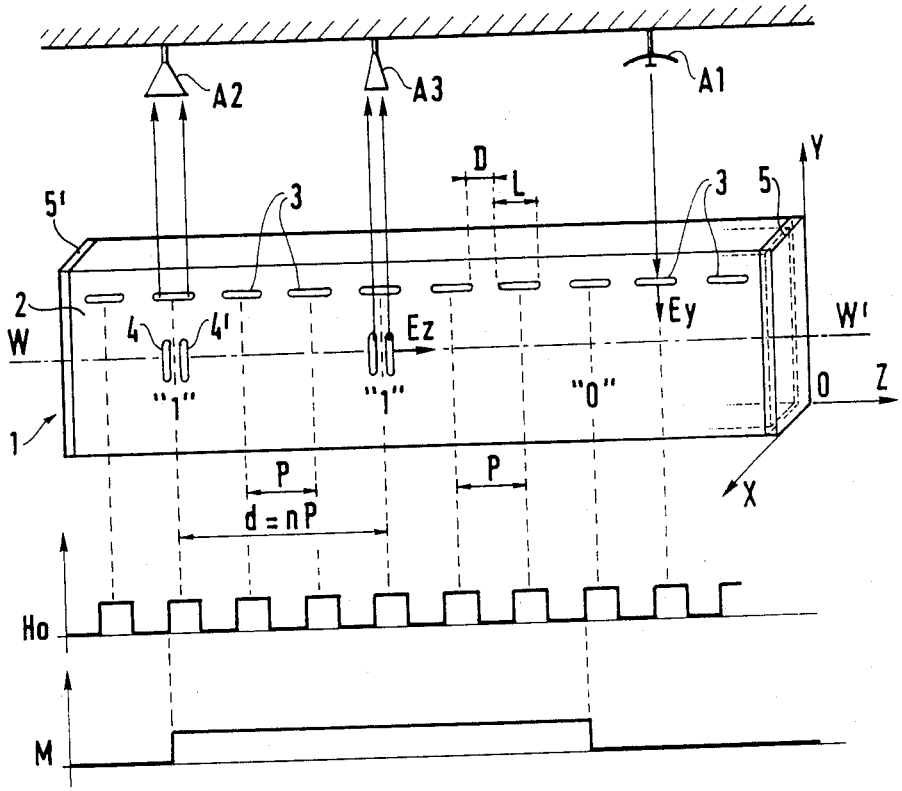
A2
A3
A1
D
L
Y
5'
3
3
5
2
W
4
4'
Ez
Ey
W'
"1"
"1"
"0"
0
Z
1
P
P
X
d = nP
Ho
M

IDENTIFICATION TRANSPONDER FOR USE WHEN A VEHICLE PASSES A GIVEN POINT

The present invention relates to an identification transponder for use when a vehicle passes a given point and is particularly, but not exclusively, applicable to rail vehicles, e.g. locomotives, and/or passenger and/or freight cars, and/or multiple units for metropolitan railways.

BACKGROUND OF THE INVENTION

French patent application number No. 2 593 761 for "A railway signalling system for recognizing the passage of a predetermined vehicle past a given point" describes a system including a fixed interrogation beacon and a passive responder fixed on the vehicle to be recognized. The beacon emits a wave modulated at a first frequency and receives a wave returned by the responder in which modulation is detected at a second frequency lower than the first frequency. The responder has no internal power source and comprises a microwave receiver, a divider for dividing the energy it receives into two equal portions, a detector, a delay line, a modulator, and a transmission antenna designed to split up the received modulated wave into pulses of width equal to the time constant of the delay line. In order to recognize different types of vehicle, responders are provided having delay lines with different time constants, and the beacon requires as many delay lines as there are types of vehicle. By detecting the modulated wave transmitted by the transponder, it is possible to recognize the time constant of the delay line fitted to the responder, and thus to determine the type of vehicle. The responder thus transmits a single signal having a special characteristic and the information which can be conveyed by such a signal is necessarily limited. In addition, the structure of the responder is relatively complicated and requires several components.

U.S. patent application Ser. No. 131,796, filed by the present Applicants on Dec. 11, 1987, for "A device for wide band transmission of information and/or instructions between a rail vehicle and a traffic control station" describes a device in which information is transmitted by means of a waveguide disposed along the track. The emitting face of the waveguide is pierced by a network of openings, with some of the openings extending perpendicularly to the longitudinal axis of the waveguide and other openings extending obliquely relative to said axis, and being disposed in a special pattern corresponding to an appropriate code. The openings extending perpendicularly to the axis transmit an axial component Ez conveying information and/or instructions, and the oblique openings transmit an additional component Ey perpendicular to the axis enabling the vehicle to determine its absolute position and any other information related thereto, in particular a maximum speed limit. The waveguide is connected to a ground station provided with transmission and reception means. The vehicle is equipped with at least one antenna for transmission and/or reception, together with transmitter and/or receiver means. The ground station connected to the waveguide transmits two microwaves at different frequencies, one of which is used for interchanging information and/or instructions, and the other of which gives rise to large amplitude fluctuations in the signals received by the antenna fixed to the vehicle and remaining in the proximity of the face of the waveguide through which the openings are pierced, so as to enable the position of the vehicle to be determined by counting the numbers of oblique openings, and thus enabling the speed of the vehicle to be measured.

This system requires a power supply both for the transmitter and for the receiver.

When identification transponders are disposed at certain points along the track, these transponders need to be equipped with self-contained power supplies, e.g. based on batteries, and even when long duration batteries are used this means that the batteries need to be checked periodically. In addition, such transponders cease to operate at low temperatures since the batteries can no longer provide enough energy.

The object of the present invention is to provide an identification transponder which is passive and which therefore does not require any kind of electrical power supply.

SUMMARY OF THE INVENTION

The present invention provides an identification transponder for use when a vehicle passes a given point, the transponder being constituted by a rectangular waveguide having a large face along an axis WW', said large face including regularly spaced-apart longitudinal slots along one of its longitudinal edges and slot pairs, each constituted by two slots extending perpendicularly to said axis and centered on said axis, each of said pairs facing a longitudinal slot, with the pairs being disposed longitudinally at a pitch of one pair for every n longitudinal slots, and with the presence of a pair corresponding to a bit of value 1 and the absence of the pair corresponding to a bit of value 0, the longitudinal slots successively receiving radiation of polarization Ey perpendicular to the axis of said large face, said radiation including a low frequency F1 and a high frequency F2, the longitudinal slots re-emitting radiation of polarization Ey at said high frequency F2, and said pairs re-emitting radiation of polarization Ez parallel to the axis of the large face at said low frequency F1, said transponder being a passive transponder having no power supply.

The transponder preferably includes at least one of the following features:

the longitudinal slots receive radiation from a transmit antenna, with the radiation emitted from the longitudinal slots being received by a first receive antenna;

the radiation emitted by the pairs is received by a second receive antenna;

said transmit and receive antennas are directional antennas at positions which are fixed relative to one another and they are displaced longitudinally relative to the transponder;

the longitudinal slots are separated from one another by a distance such that the radiation they emit at the high frequency F2 has an amplitude maximum whenever the transmit antenna is facing one of the longitudinal slots, and a minimum amplitude whenever the transmit antenna is between two longitudinal slots;

the radiation received by the first receive antenna during displacement relative to the transponder is a periodic signal whose period is a function of the speed of said displacement;

the pairs constitute a message in binary code, with the length of the waveguide being a function of the length of the message;

the transponder is stationary and the antennas are fixed to a vehicle;

the transponder is fixed to a vehicle and the antennas are stationary; and the waveguide is closed at each end by a matched load.

BRIEF DESCRIPTION OF THE DRAWING

A transponder in accordance with the invention is described below by way of example and with reference to the sole FIGURE of the accompanying drawing which shows a transponder in accordance with the invention, together with antennas and two waveform diagrams relating to the two sets of openings provided in said transponder.

DETAILED DESCRIPTION OF THE INVENTION

In the FIGURE, the transponder of the invention is constituted by a rectangular waveguide 1 determining a rectangular frame of reference OXYZ with the axis OZ extending along the length of the guide, the axis OX extending in the plane of the small face of the guide and with the axis OY extending in the plane of the large face 2 of the guide.

The large face 2 of the waveguide has longitudinal slots 3 disposed along the length of the waveguide close to one of its edges, with the lengths of the slots 3 extending along the axis OZ and with said slots being separated from one another by distances D.

Said large face 2 also includes slot pairs each constituted by two slots 4 and 4' centered on the longitudinal axis WW' of the large face level with a longitudinal slot 3. The pairs are distributed along the longitudinal axis WW' at a rate of one pair every n longitudinal slots, where n is not less than 3. The distance d between two successive pairs is thus $d=nP$, where n is not less than 3 and P is the pitch of the longitudinal slots, and with the figure showing the case where $n=3$. The presence of a pair corresponds to a bit of value "1" and the absence of a pair corresponds to a bit of value of "0", as shown in the FIGURE. The set of pairs in the transponders constitutes a binary-encoded message. The length of the transponder is thus a function of the length of the message.

The large face 2 of the waveguide is made of a plastic material covered with metallization with the longitudinal slots and the pairs being etched therein, and the waveguide is closed at its ends by matched loads 5, 5'. As a result the inside of the waveguide is isolated from the outside and no foreign bodies such as dust, water, snow, etc. can penetrate therein.

The FIGURE includes a diagrammatic representation of a transmit antenna A1, a first receive antenna A2, and a second receive antenna A3, with all three antennas being in positions which are fixed relative to each other, and with said antennas and the transponder being disposed to move relative to each other as described below, with said relative displacement taking place along the longitudinal axis WW', which is itself parallel to the axis OZ, and with the antennas facing the large face 2 of the transponder during such displacement.

The transmit antenna A1 transmits two low-power signals (e.g. at 0.1 watts), one of them being at a low frequency F1, and the other being at a high frequency F2, and with both frequencies lying in the frequency band 1 GHz to 10 GHz. The signals may optionally be modulated.

The transmit antenna A1 is a directional antenna transmitting towards the transponder, and it is situated facing the longitudinal slots 3 during the above-mentioned relative displacement. It radiates signals with polarization Ey, i.e. along the axis OY, so as to excite successive longitudinal slots during relative displacement, with the transmit antenna exciting only one longitudinal slot at a time when it faces it. Radiation theory applied to a network of openings made in a conductive plane shows that it is possible to determine an inter-opening pitch such that: at the low frequency F1 the electromagnetic field transmitted by the network of openings is uniform, i.e. its amplitude does not depend on the transmit antenna being positioned over an opening or between two successive openings; in contrast at the high frequency F2 said field amplitude varies, taking on a maximum value when the transmit antenna is facing one of the longitudinal slots 3 and a minimum value when the transmit antenna is between two longitudinal slots. In the transponder shown in the FIGURE, the pitch P of the longitudinal slots 3 is such that said longitudinal slots emit radiation at the high frequency F2, with said radiation having polarization Ey such that the amplitude of said radiation depends on the relative position between the transmit antenna and a longitudinal slot. The radiation from each longitudinal slot is picked up by the first receive antenna A2 which is a directional antenna, e.g. of the horn type. The pitch P of the longitudinal slots 3 is equal to $D+L$, where L designates the length of each longitudinal slot. For a high frequency $F2=2.5$ GHz, for example, L is about one-half the wavelength, i.e. about 60 millimeters (mm) and D is about 61 mm.

The slots 4 and 4' in each pair emit radiation having polarization Ez at the low frequency F1 whose amplitude does not depend on the position of the transmit antenna A1 relative to the longitudinal slots. The distance between the two slots of a pair is less than half the wavelength $\frac{1}{2}\lambda 1$ of the low frequency F1. For $F1=2.4$ GHz, this distance is less than 6.25 centimeters. The radiation from each pair is picked up by the second receive antenna A3 which is a directional antenna, e.g. of the horn type. The receive antennas A2 and A3 are thus perpendicular to each other. They are also at a distance from the transmit antenna A1 in order to avoid picking up the direct field radiated by said transmit antenna. The distance between the transmit antenna and the receive antennas may, for example, be at least two or three wavelengths 1 of the low frequency F1.

In the FIGURE, waveform diagrams Ho and M respectively represent a clock signal and a message.

The clock signal Ho corresponds to the signal received by the first receive antenna A2 after shaping. There is thus one clock pulse per longitudinal slot 3.

The signal M corresponds to the signal received by the second receive antenna A3 after shaping. It thus takes on the value 1 whenever a pair is present on the transponder and the value 0 whenever a pair is not present. In the FIGURE, the message signal M keeps its value 1 until the next pair, and retains this value if a pair is present or else takes on the value 0 if a pair is not present. The signals from the pairs are taken into account once every n clock signal pulses, with the signals then being detected as being at maximum amplitude (bit=1) or else at minimum amplitude (bit=0). The clock signal Ho also serves to measure the speed of relative displacement between the transponder and the antennas, or vice versa, by measuring the frequency of the clock signal, with the pitch P being known. It may be observed that the message M constituted by a sequence of bits is independent of the relative speed between the transponder and the antennas. Only the duration of the bits depends on the speed and this does not alter the reading of the transponder, and thereby does not alter the message conveyed thereby.

A transponder of the invention may be stationary and disposed, in a railway context, between the rails of the track or along the side of the track, in which case the antennas are fixed to a vehicle provided with a power supply, e.g. the locomotive of a train. In this case, the message carried by a transponder may be a speed limit, or a message for identifying the exact location of the vehicle. Conversely, the antennas may be fixed between the rails or along the side of the track and the transponder may be fixed to a locomotive or to a freight or passenger car. Each car may be fitted with a transponder, in which case each transponder should provide a different message, thereby enabling each car to be identified without it being necessary for the car to have its own supply or energy.

Naturally, the application of a transponder in accordance with the invention to railways is merely by way of example, such a transponder can be used, more generally, whenever a message is to be transmitted between a vehicle passing a transponder or each time a vehicle needs to transmit a message whenever it passes a given location, in which case the vehicle is provided with a transponder in accordance with the invention.

We claim:

1. An identification transponder for use when a vehicle passes a given point, the transponder being constituted by a rectangular waveguide having a large face along a waveguide axis WW', said large face including regularly spaced-apart longitudinal slots along one of its longitudinal edges and having longitudinal axes extending substantially parallel to said waveguide axis and slot pairs, each slot pair constituted by two slots having axes extending perpendicularly to said waveguide axis and centered on said waveguide axis, each of said pairs being adjacent a longitudinal slot, with the pairs being disposed along said waveguide axis at a pitch of one pair for every n longitudinal slots; and with the presence of a pair corresponding to a bit of value 1 and the absence of the pair corresponding to a bit of value 0, the longitudinal slots successively receiving radiation of polarization Ey perpendicular to said waveguide axis, said radiation including a low frequency F1 and a high frequency F2, the longitudinal slots re-emitting radiation of polarization Ey at said high frequency F2, and said pairs reemitting radiation of polarization Ez parallel to said waveguide axis at said low frequency F1, said transponder being a passive transponder having no power supply.

2. A transponder according to claim 1, wherein the longitudinal slots receive radiation from a transmit antenna, with the radiation emitted from the longitudinal slots being received by a first receive antenna, the radiation emitted by the pairs being received by a second receive antenna, and said transmit and receive antennas being directional antennas at positions which are fixed relative to one another and being displaced longitudinally relative to the transponder.

3. A transponder according to claim 2, wherein the longitudinal slots are separated from one another by a distance such that the radiation they emit at the high frequency F2 has an amplitude maximum whenever the transmit antenna is facing one of the longitudinal slots, and a minimum amplitude whenever the transmit antenna is between two longitudinal slots.

4. A transponder according to claim 3, wherein the radiation received by the first receive antenna during displacement relative to the transponder is a periodic signal whose period is a function of the speed of said displacement.

5. A transponder according to claim 2, wherein the presence or absence of the pairs represents a message in binary code, with the length of the waveguide being a function of the length of the message.

6. A transponder according to claim 2, wherein the transponder is stationary and the antennas are fixed to a vehicle.

7. A transponder according to claim 2, wherein the transponder is fixed to a vehicle and the antennas are stationary.

8. A transponder according to claim 1, wherein the waveguide is closed at each end by a matched load.

* * * * *